US005556466A

United States Patent [19]

Martin et al.

[11] Patent Number: 5,556,466

[45] Date of Patent: Sep. 17, 1996

[54] COATING PLANT

[75] Inventors: Wolfram Martin, Ilsfeld; Hartwig Besinger, Erdmannhausen; Heinrich Weeber, Asperg, all of Germany

[73] Assignee: Duerr GmbH, Stuttgart, Germany

[21] Appl. No.: 297,298

[22] Filed: Aug. 29, 1994

[30] Foreign Application Priority Data

Sep. 1, 1993 [DE] Germany ..... 43 29 384.0

[51] Int. Cl.[6] ..... B05C 13/02

[52] U.S. Cl. ..... 118/67; 118/65; 118/68; 198/465.1

[58] Field of Search ..... 118/58, 64, 65, 118/66, 67, 68; 198/465.1

[56] References Cited

U.S. PATENT DOCUMENTS

| | | | |
|---|---|---|---|
| 1,706,554 | 3/1929 | Weber | 34/500 |
| 2,945,471 | 7/1960 | Harrold | 118/58 |
| 3,312,330 | 4/1967 | Juengel | 198/369.2 |
| 4,564,100 | 1/1986 | Moon | 198/341 |
| 4,593,624 | 6/1986 | Spiker | 104/172.3 |
| 4,691,640 | 9/1987 | Muria | 104/140 |
| 4,827,598 | 5/1989 | Sakamoto et al. | 29/430 |
| 5,149,371 | 9/1992 | Tateuchi et al. | 118/56 |

FOREIGN PATENT DOCUMENTS

| | | |
|---|---|---|
| 0436081 | 7/1991 | European Pat. Off. . |
| 2120134 | 8/1972 | France . |
| 2913689 | 10/1980 | Germany . |
| 3612128 | 10/1986 | Germany . |
| 4127580 | 2/1993 | Germany . |
| 4222349 | 1/1994 | Germany . |
| 63062 | 4/1949 | Netherlands . |
| 2182011 | 7/1986 | United Kingdom . |
| WO93/05355 | 3/1993 | WIPO . |

*Primary Examiner*—Donald E. Czaja
*Assistant Examiner*—Calvin Padgett
*Attorney, Agent, or Firm*—Barry R. Lipsitz; Ralph F. Hoppin

[57] ABSTRACT

In order to improve a coating plant for workpieces, in particular for vehicle bodies, comprising a coat application section, a coat drier section following the application section and comprising a drier booth arranged at a higher level in relation to the coat application section, a skid conveyor on the inlet side passing through the coat application section, the skid conveyor moving workpieces mounted on skid frames through the coat application section at a process feeding speed for the application of the coating, and a drier conveying device following the skid conveyor and conveying the skid frames with the coated workpieces mounted thereon through the coat drier section, such that this is simpler in its construction than the known coating plants it is suggested that the drier conveying device be a drier conveyor following the skid conveyor and moving the skid frames at the process feeding speed along a skid frame path through the coat drier section, that the drier conveyor extend beneath the skid frame path and that the drier conveyor take over the skid frames at the conveyor level of the skid conveyor and lift them via an inclined plane to the conveyor level of the drier booth and subsequently convey them therethrough.

39 Claims, 12 Drawing Sheets

COATING PLANT

BACKGROUND OF THE INVENTION

The invention relates to a coating plant for workpieces, in particular for vehicle bodies, comprising a coat application section, a coat drier section following this application section and comprising a drier booth arranged at a higher level in relation to the coat application section, a skid conveyor on the inlet side passing through the coat application section, this skid conveyor moving workpieces mounted on skid frames through the coat application section at a process feeding speed for the application of the coating, and a drier conveying device following the skid conveyor and conveying the skid frames with the coated workpieces mounted thereon through the coat drier section.

Coating plants of this type are known from the state of the art. These have a drier conveying device which is designed such that it comprises a lifting device which lifts the skid frames coming from the skid conveyor on the inlet side so that these can then pass through the coat drier section. Once they have passed through the coat drier section, the skid frames are lowered again by a lifting device.

A coating plant of this type is complicated in its conception since, for loading the lifting device, acceleration distances are necessary in order to separate the individual skid frames conveyed by the skid conveyor at a process feeding speed one after the other and to gain the time required for the lifting procedure.

SUMMARY OF THE INVENTION

The object underlying the invention is therefore to improve a coating plant of the Generic type such that this is simpler in its construction than the known coating plants.

This object is accomplished in accordance with the invention, in a coating plant of the type described at the outset, in that the the drier conveying device is a drier conveyor following the skid conveyor and moving the skid frames at the process feeding speed along a skid frame path through the coat drier section, that the drier conveyor extends beneath the skid frame path and that the drier conveyor takes over the skid frames at the conveyor level of the skid conveyor and lifts them via an inclined plane to the conveyor level of the drier booth and subsequently conveys them therethrough.

The advantage of the inventive solution is to be seen in the fact that the complicated lifting devices and, therefore, the devices for separating the individual skid frames can be dispensed with and that, in addition, the drier conveyor extends beneath the skid frame path so that dirt particles generated by it cannot fall onto the workpiece.

Moreover, the inventive coating plant is designed to be simpler in its construction and therefore also less susceptible to breakdowns.

The inventive design of the coating plant is particularly suitable when the coating plant comprises an additional work section following the coat drier section and having a skid conveyor on the outlet side. An additional work section of this kind can include all types of finishing or supplementary work, and, for example, also the mere transporting of the skid frames to a subsequent working station which does not entail any coating process at all or any work connected thereto but the further assembly of a vehicle.

In this case, it is particularly advantageous for the drier conveyor to convey the skid frames in an end region of the coat drier section via an inclined plane downwards to a skid conveyor on the outlet side.

The term "skid frame" used in conjunction with the inventive solution covers all transport devices for the workpiece which have at least two skid runners which are arranged in spaced relation to one another transversely to the direction of transport and, in particular, are rigidly connected to one another. They are, for example, connected to one another by at least two crossbars and held at a distance from one another. It is, however, also possible to mount the skid runners directly on the workpiece, for example on a vehicle body, so that the workpiece itself provides the connection of the skid runners with one another.

A skid frame of this type is preferably conveyed on skid conveyors which have two sets of rollers for the skid runners arranged in spaced relation to one another and between these a drive, for example, a stepped drive for advancing the skid frames at the process feeding speed, which ensure a stable and wobble-free transport of the workpiece mounted on the skid frame, in particular for treatment processes sensitive to positioning, such as, for example, the application of a coating.

In the inventive solution it is preferable for the skid frames to be guided in the region of the drier conveyor along the skid frame path with their skid runners free from runner tracks. This has the great advantage that with respect to the skid frame path, along which the skid frames are transported with the drier conveyor, no consideration has to be given to the structural conditions of a skid conveyor and the requirements resulting from the skid runners running on sets of rollers. In this respect, it is particularly expedient that the skid frames can be moved on tighter curve radii than would the case for skid conveyors which normally allow only a movement of the skid frames in one direction or with slight deviations from this direction.

Within the scope of the inventive embodiments, it has proven to be particularly expedient for the skid conveyor to bring the skid frames to a transfer station and for the drier conveyor to take up the skid frames in the transfer station and then transport them preferably free from the customary runner tracks from this transfer station onwards.

In order to be able to carry out this transfer of the skid frames in the transfer station particularly simply and reliably, it is expedient for the drier conveyor to approach the respective skid frame from below in the transfer station with a skid frame pickup and to take up this skid frame so that the skid frame is completely carried by the drier conveyor, especially following the transfer station.

With respect to the pickup of the skid frames by the skid frame pickup, no details have so far been given. It is, for example, particularly favorable, especially in order to be able to ensure a stable guidance of the skid frame in the drier conveyor, for the skid frame pickup to support the skid frames at two places spaced from one another in the direction of conveyance with a respective supporting element. This ensures, in particular, a pickup secured against any tilting about an axis extending transversely to the direction of conveyance.

With respect to the support of the skid frames by the skid frame pickup, it would, for example, be possible in an advantageous embodiment for the skid frame pickup to support the skid frame at a crossbar thereof in the region between the skid runners. It would be even more advantageous for the skid frame pickup to support the skid frame at two crossbars of the skid frame arranged in spaced relation to one another in the direction of conveyance.

It has, however, proven to be particularly advantageous for the skid frame pickup to support the skid frame at its skid runners since, in this case, a broad and, therefore, reliable support of the skid frames themselves transversely to the conveyance results and this displays a quality which corresponds to the quality of the support in the skid conveyor itself.

Such a support of the skid frame by the drier conveyor can be realized particularly simply when the drier conveyor supports the skid frame with its two supporting elements, whereby the supporting elements each have support surfaces for the respective skid frame.

To prevent the skid frame slipping sideways on the supporting elements, it is, in addition, provided for the supporting elements to have guide surfaces, on which, for example, the skid runners abut and are thereby secured against displacement transversely to the direction of conveyance.

Within the scope of the inventive solution, it has proven to be particularly expedient for the precise guidance of the skid frame pickup for this to be guided with two carriages on a guide rail.

The carriages are preferably guided in the guide rails with two pairs of support rollers arranged in spaced relation to one another so that this results in a secure and reliable guidance of the carriages, which precludes any tilting thereof in relation to the guide rails.

With respect to the connection of the carriages with a conveying element of the drier conveyor, no details have so far been given.

In a preferred embodiment, the supporting elements are each seated on their own carriage and the carriages are, in particular in the simplest case, connected with one another via a conveying element or part of a conveyor belt.

In this case, it is expedient for the conveying element to be formed by a chain, the links of which are movable relative to one another preferably only about one axis so that this embodiment of the conveyor chain merely allows the guidance thereof in curves located in one plane.

This is preferably a plane lying essentially vertically so that the conveyor chain curves merely in this plane and, on the other hand, has the property of guiding the supporting elements so as to be aligned parallel to one another transversely to the direction of conveyance, in particular transversely to the vertical plane, so that apart from the connection through the conveyor chain no further connection is required between the two supporting elements.

In order to make it possible to adjust the length when passing through a curve, it is preferable for at least one of the supporting elements to be variably supported in the direction of conveyance on the respective skid frame. The supporting element preferably has a support roller for this purpose.

In an advantageous embodiment, for example, one of the carriages is rigidly connected to the conveying element and the other carriage is freely movable in relation to the conveying element.

This allows the two carriages to be connected to one another via a longitudinal support, whereby an adjustment of the length, due to the alignment of the longitudinal support parallel to a chord of an arc of a curve to be passed through, is possible due to the relative movability of the other carriage in relation to the conveying element.

In this case, the two supporting elements are preferably arranged on the longitudinal support.

In order, in this case, to be able to travel through a curve in a plane, it is particularly advantageous for the longitudinal support to be connected to each of the carriages via at least one joint, in particular when the carriages have two sets of support rollers arranged in spaced relation to one another.

The two joints are then arranged, in particular, such that their joint axes are parallel to one another and preferably perpendicular to the plane, in which the conveying element is intended to make a curve.

In particular when the conveying element is intended to make a curve in two planes preferably extending vertically on top of one another, it is advantageous for the carriages to be connected with the longitudinal support via two joints, whereby the two joints allow a pivoting movement about two axes extending vertically on top of one another and also to the direction of conveyance and, on the other hand, the axes of the two joints are again aligned preferably parallel to one another between the two carriages and the longitudinal support.

With respect to the conveying element, no further details have been given in these embodiments. The conveying element can be any type of element which is suitable for making a curve in the desired planes. A conveyor chain has proven to be successful as conveying element since this can be guided particularly reliably and with adequate preciseness and simplicity.

In this respect, the conveyor chain is designed, in particular, such that it has chain links which are movable relative to one another at least about one axis, whereby this axis is vertical to the plane, in which the curve to be made by the conveyor chain is located.

The embodiment described in the above is, however, particularly suitable when the conveyor chain is in a position to make a curve in a plurality of, for example at least two, planes. In this case, it is advantageous for the chain links to be pivotable relative to one another about two axes, whereby the two axes are each vertical to the planes, in which the conveyor chain makes a curve.

In this respect, it is particularly advantageous for the two axes, about which the chain links can be pivoted relative to one another, to extend parallel to the two axes of the joints between the carriages and the longitudinal support.

Within the scope of the inventive solution, the chain can also be designed such that it provides for an even greater movability between the individual chain links.

With a drier conveyor of this type, it is particularly advantageous for this to make a curve in a plane which is essentially vertical and preferably in a horizontal plane as well.

It is possible, in particular, in such a drier conveyor for this to make a curve in a horizontal plane in the coat drier section, preferably a turning circle or loop.

In such an embodiment of an inventive drier conveyor it is, for example, possible to have the conveying element placed in an essentially horizontal plane in the coat drier section and, following this, to have the conveying element placed in a horizontal plane also in the region of the transfer stations, whereby the conveying element is guided over a respective inclined plane, in particular, between the transfer stations and the coat drier section.

Within the scope of the embodiments described so far, it has merely been specified how the skid frame pickup supports the skid frames. No details have, however, been given as to how the skid frames are to be taken along by the drier conveyor.

In an advantageous embodiment, the drier conveyor engages on the respective skid frame with an entrainment means detachably connectable to the skid frame.

The entrainment means is expediently designed such that it engages on an entrained element arranged on the skid frame. It would, for example, be possible to design the entrained element as an independent element suitable for use as the entrainment means.

It is, however, even more advantageous for the entrained element to be formed by a crossbar of the skid frame.

With respect to the entrainment means, no particular details have so far been specified. In an advantageous embodiment, for example, the entrainment means secures the skid frame against any relative movement in the direction of conveyance or contrary to the direction of conveyance.

It is preferably provided for the entrainment means to have an entrainment surface arranged behind the entrained element in the direction of conveyance and an entrainment surface arranged in front of the entrained element in the direction of conveyance.

In this respect, the entrainment means can be brought into engagement with the entrained element in the most varied of ways. In an advantageous embodiment, for example, the entrainment means is securable on the entrained element by locking.

In this case, it is preferably provided for the entrainment surface to be seated on a pawl. It is particularly advantageous for the entrainment means to be secured on the entrained element in such a manner when the front entrainment surface in the direction of conveyance is seated on the pawl since, in this case, it is possible to approach the entrained element in the transfer station in the direction of conveyance with the entrainment means due to relative movement in relation to the skid frame and thereby pivot the pawl such that the front entrainment surface in its pivoted position can pass the entrained element and once the pawl is pivoted back can then be brought into a position in front of the entrained element, in which it secures the entrained element.

The pawl can be actuated in the most varied of ways. In this respect, it is particularly advantageous for the pawl to have an inclined abutting surface, with which it is movable against the entrained element itself.

Alternatively to securing the entrainment means on the entrained element by locking, another embodiment provides for the entrainment means to be brought into engagement with the entrained element by the entrainment means being movable up to the entrained element from an underside, whereby in this case the skid frame bearing the entrained element and the entrainment means are moved at the same speed and the entrainment means comes increasingly closer to the entrained element from below.

However, this requires, in addition, an exact positioning of the entrainment means relative to the entrained element during the phase in which the two elements are intended to be brought into engagement.

With respect to the entrainment means, no further details have been given in conjunction with the previous comments on individual embodiments. In a particularly advantageous embodiment, for example, the entrainment means is arranged on a supporting element.

Preferably, two entrainment means are provided on a supporting element next to one another in transverse spaced relation and they ensure a reliable fixing and canting-free entrainment of the skid frame.

With respect to the guidance of the conveying element itself, no details have been specified in conjunction with the previous description of any of the embodiments. In an advantageous embodiment, the conveying element extends between the guide rails for the carriages.

Alternatively thereto, the conveying element is arranged to be vertically offset in relation to the plane, in which the carriages run on the guide rails, i.e. is located above or below this plane. This has proven to be advantageous, in particular, when one of the carriages is freely movable relative to the conveying element, i.e. it is not rigidly connected thereto.

Additional features and advantages of the invention are the subject matter of the following description as well as the drawings of several embodiments.

DETAILED DESCRIPTION OF THE INVENTION

Figure 1:
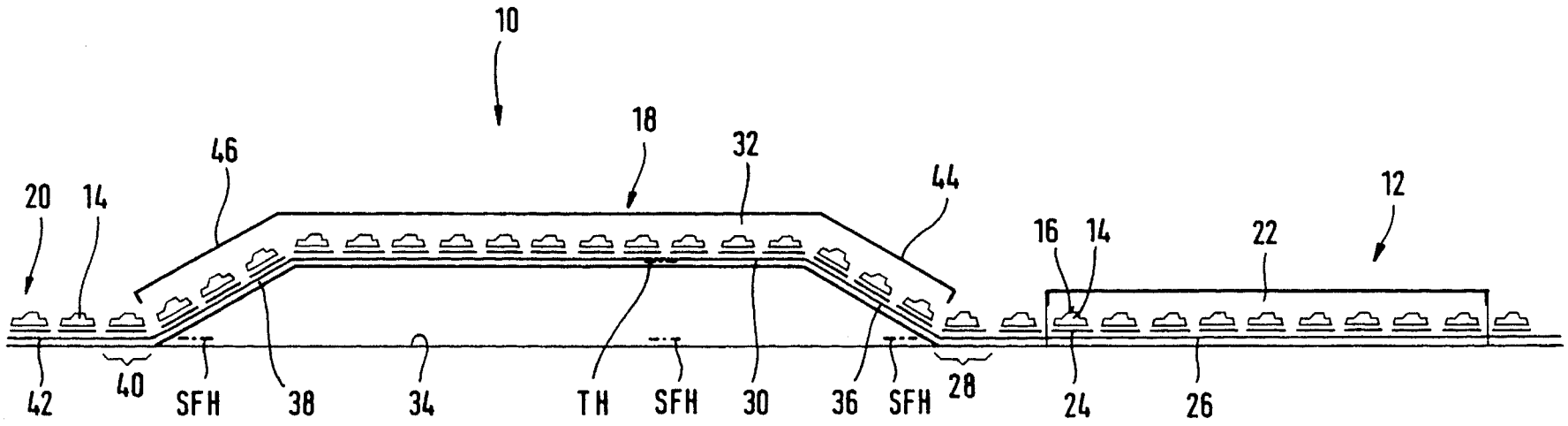
FIG. 1 is a schematic illustration of a first embodiment of an inventive coating plant.

A coating plant schematically illustrated in FIG. 1 and designated as a whole as 10 comprises a coat application section 12, in which a coating 16 is applied to a workpiece 14, in particular to a vehicle body 14, a coat drier section 18 following the coating section 12, in the course of which the coating 16 on the workpiece 14 is dried and an additional work section designated as a whole as 20, in which additional finishing or further work is carried out on the workpiece 14 provided with the dried coating 16.

The coat application section 12 comprises a coating booth designated as a whole as 22, through which the workpieces 14 mounted on a skid frame 24 are transported by means of a skid conveyor 26 and coated in the known manner, for example with paint spraying devices. With this skid conveyor 26, the workpieces 14 coming out of the coating booth 22 and provided with the coating 16 are transported into a transfer station designated as a whole as 28, in which a drier conveyor designated as a whole as 30 takes up the skid frames 24 together with the workpieces 14 seated thereon and conveys them through the coat drier section 18.

A drier booth designated as a whole as 32 is arranged in the coat drier section 18. This booth is arranged at a higher level above the ground surface 34 than the coating booth 22 and requires the skid frames 24 to be transported to a drier level TH which is higher than a skid conveyor level SFH, at which the skid frames 24 are conveyed by the skid conveyor 26.

The drier conveyor 30 takes over the skid frames 24 in the transfer station 28 at skid conveyor level SFH and transports these along an imaginary skid frame path via an inclined plane 36 to the drier level TH, at the drier level TH through the entire drier booth 32, subsequently again via an inclined plane 38 back to skid conveyor level SFH and transfers the skid frames 24 again in a transfer station 40 to a skid conveyor 42 on the outlet side which transports the skid frames 24 through the additional work section 20 proceeding from the transfer station 40.

The drier booth 32 is preferably a customary paint drier booth which serves to dry the paint 16 applied to the workpieces 14 in the coating booth 22. The drier booth also comprises, to avoid heat losses, an inlet air lock designated as a whole as 44 which extends from the drier booth 32 via the inclined plane 36 preferably as far as the skid conveyor level SFH and takes up the workpieces 14 essentially at the skid conveyor level SFH or slightly thereafter.

Similarly, the drier booth 32 is preferably provided with an outlet air lock 46 which extends from the drier booth 32 via the inclined plane 38 likewise downwards again essentially as far as the skid conveyor level SFH and encloses the workpieces 14 essentially as far as the skid conveyor level SFH.

In order to keep the heat losses in the drier booth 32 as low as possible, air is drawn in large amounts through both the inlet air lock 44 and the outlet air lock 46.

Figure 2A:
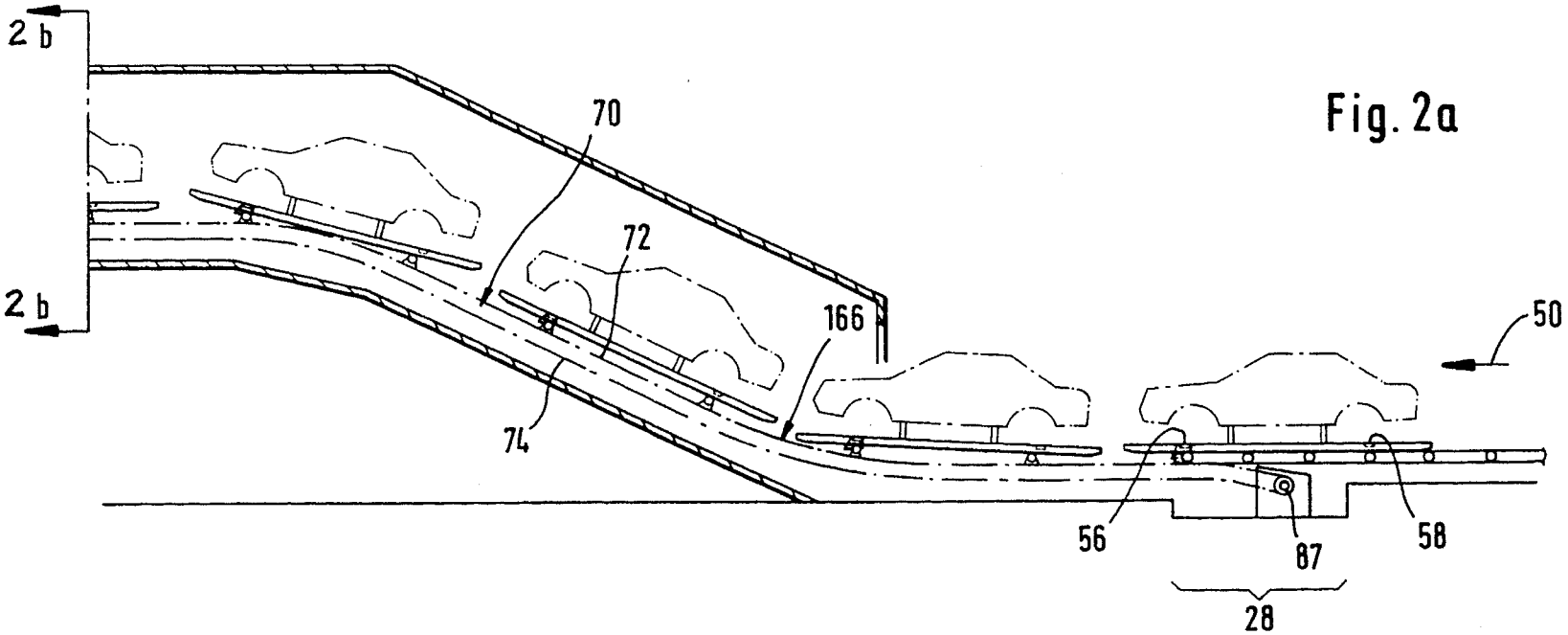
FIGS. 2*a, b* show an enlarged side view of sections in the region of the transfer station and the inclined planes of the drier conveyor.
Figure 3A:
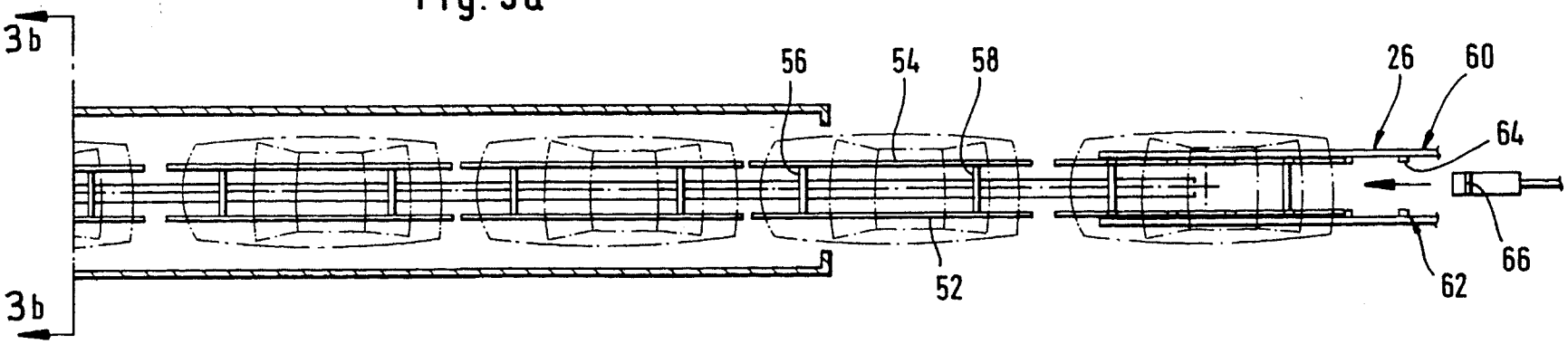
FIGS. 3*a, b* show a plan view onto the sections shown in FIGS. 2*a, b;*
Figure 2B:
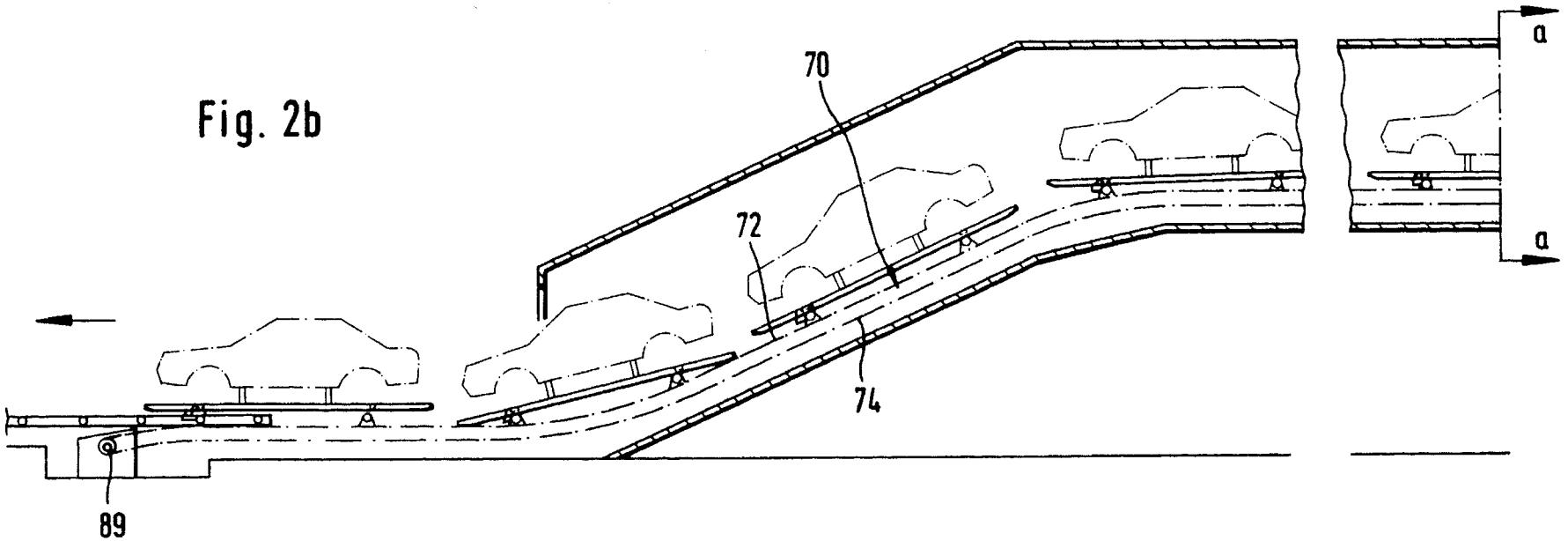
Figure 3B:
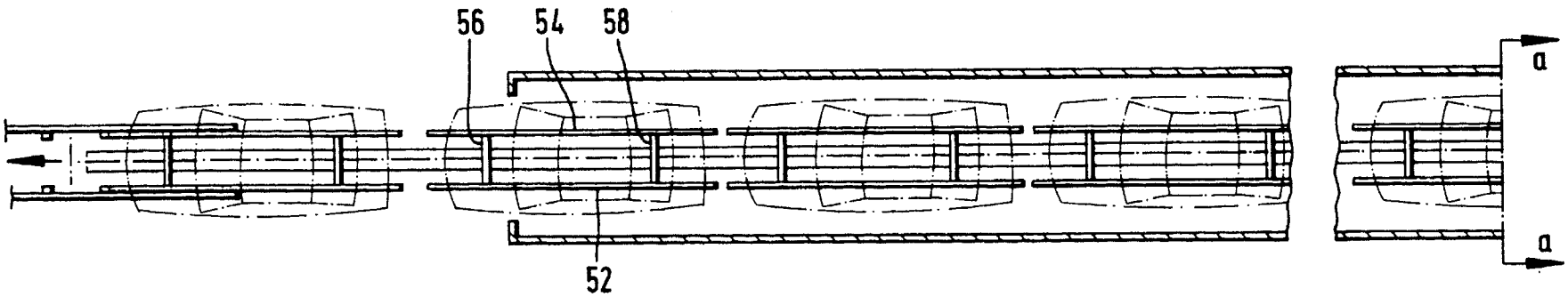

As illustrated in FIGS. 2 and 3, each skid 24 comprises two skid runners 52 and 54 arranged in spaced relation to one another transversely to the direction of conveyance 50. These runners are connected to one another by a front crossbar 56 and a rear crossbar 58 and form the skid frame 24. In the region of the skid conveyor 26, the skid frame 24 is supported in the region of its two skid runners 52, 54 by a respective track 60 and 62 each having a set of rollers 64 arranged one behind the other parallel to the direction of conveyance 50. In addition, the skid frame 24 is also advanced, for example by advancing fingers 66 engaging on the crossbars 56 or 58. These fingers are preferably movable between the tracks 60 and 62 in the direction of conveyance 50 and contrary thereto and push the skid frames 24 in the direction of conveyance 50 at a process feeding speed, for example in a predetermined cycle over a predetermined distance.

A skid conveyor 26 of this type is described, for example, in the European patent application 0 436 081.

Figure 4:
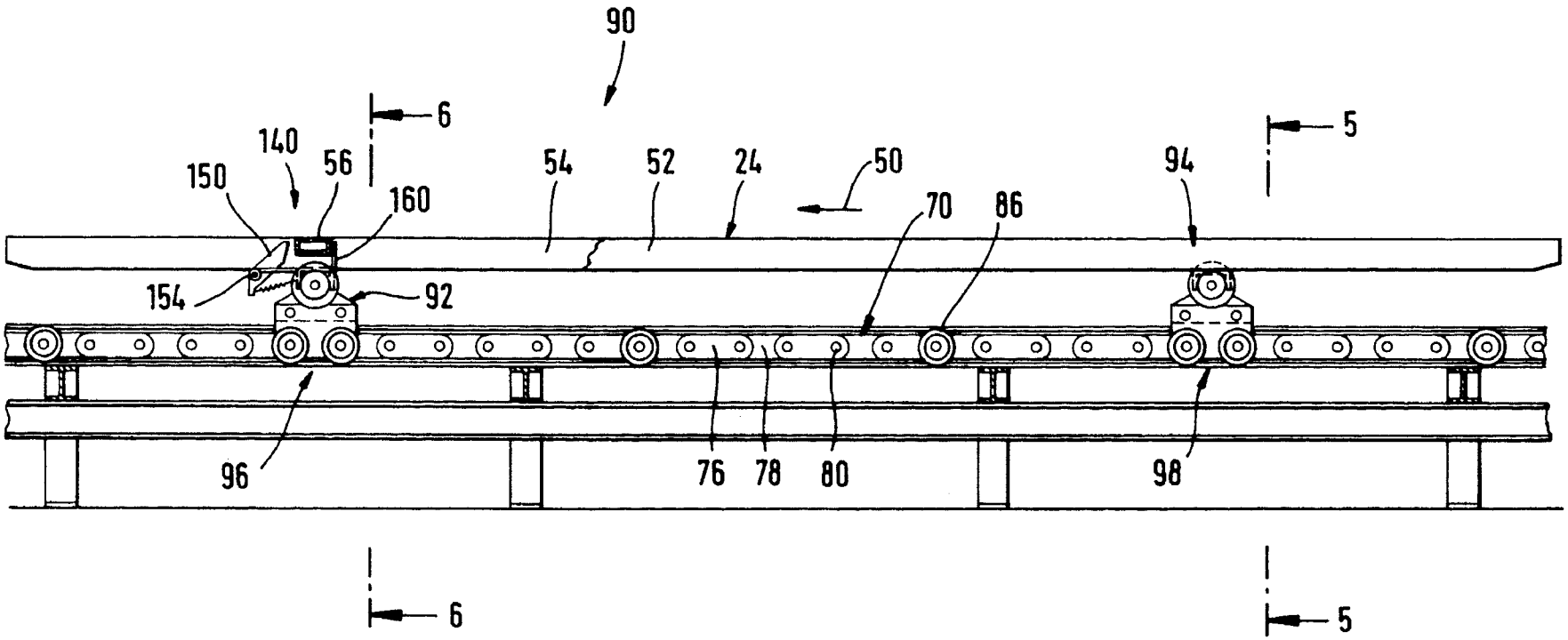
FIG. 4 is an enlarged illustration of a detail of a skid pickup and guidance thereof on the conveyor chain.
Figure 5:
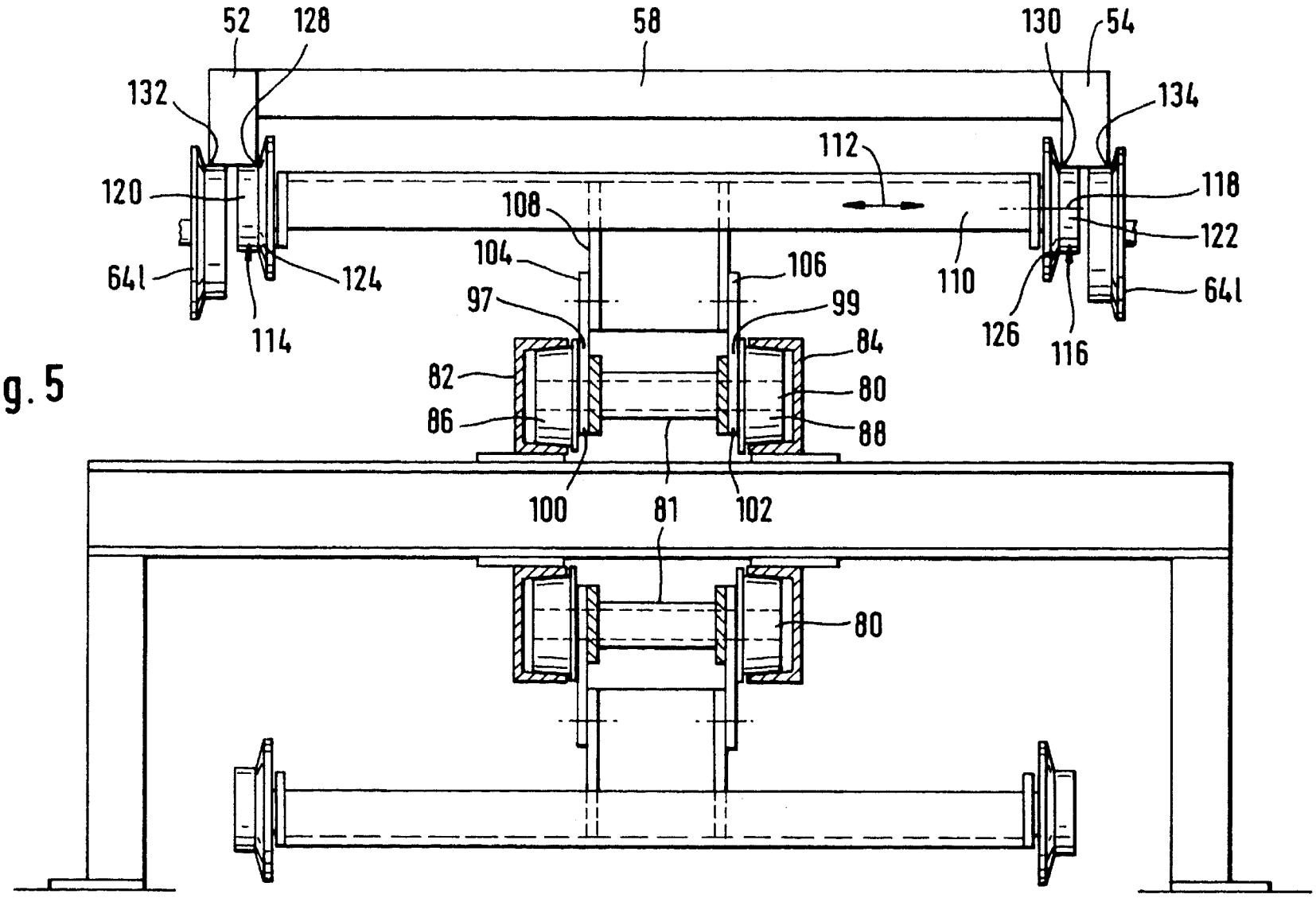
FIG. 5 is a section along line 5—5 in FIG. 4.
Figure 6:
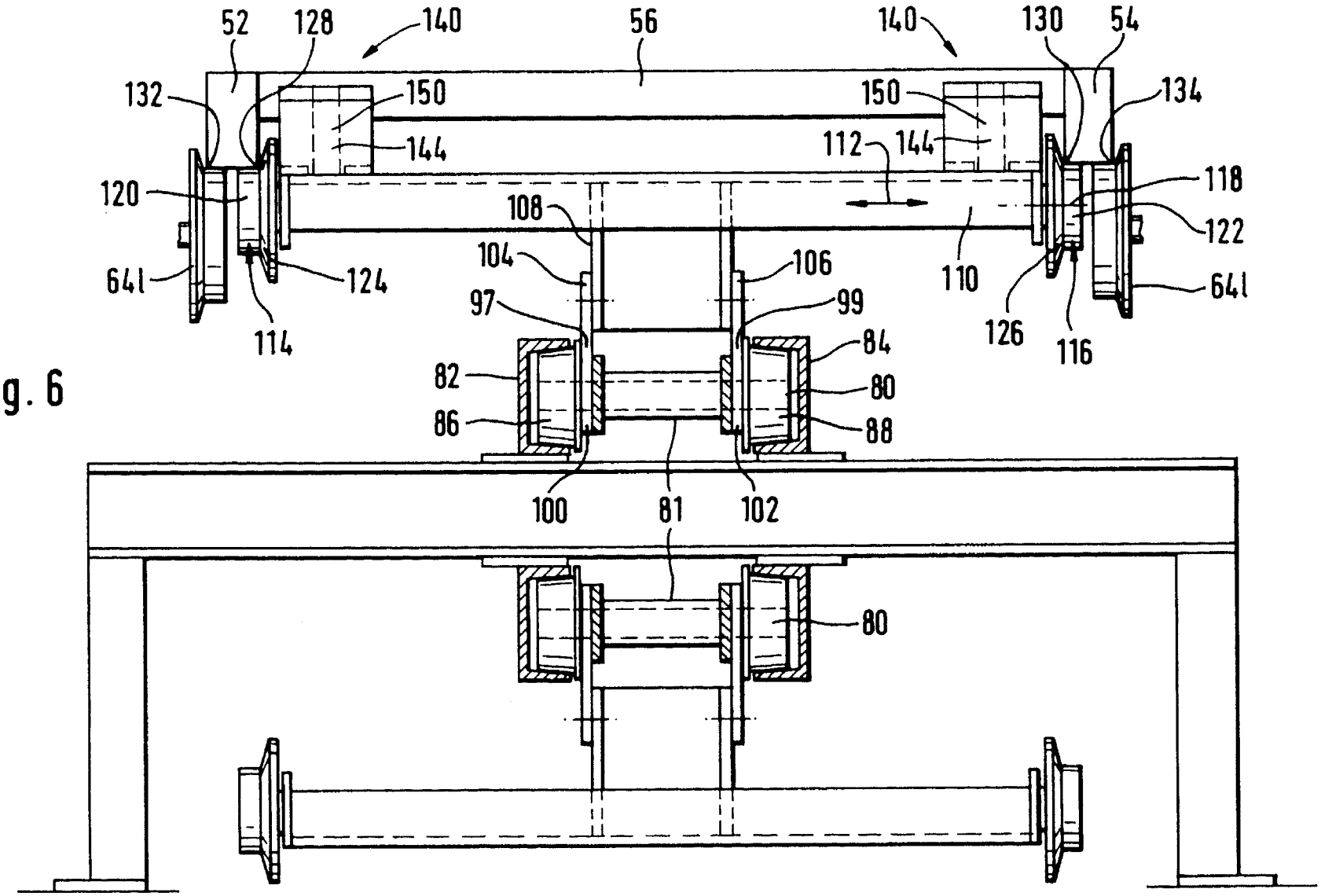
FIG. 6 is a section along line 6—6 in FIG. 4.

As illustrated in FIGS. 4 to 6, the drier conveyor 30 comprises a conveyor chain designated as a whole as 70 which runs with an upper part 72 from the transfer station 28 as far as the transfer station 40 in the direction of conveyance 50 and runs back with a lower part 74 arranged beneath the upper part 72 from the transfer station 40 as far as the transfer station 28. The upper part 72 and the lower part 74 are preferably located in a vertical plane exactly underneath one another.

The conveyor chain 70 is preferably constructed from chain link or joint plates 76 and 78 articulatedly connected with one another in a plane, in this case a vertical plane. These joint plates are arranged in pairs in spaced relation to one another transversely to the direction of conveyance 50 and are connected with one another each time by a joint pin 80, whereby outer joint plates 76 which are arranged in pairs alternate with inner joint plates 78 which are arranged in pairs inside the outer joint plates 76 and are rigidly connected with one another by a sleeve 81 for the joint pin 80. The joint pins 80 are at right angles to the vertical plane, in which the joint plates 76 and 78 are movable relative to one another.

Profiled supports 82 and 84 C-shaped in cross section are provided for the guidance of the conveyor chain 70. These profiled supports are arranged on both sides of the chain and face one another with their open sides. Support rollers 86 and 88 of the conveyor chain 70 run in these profiled supports 82 and 84 and are likewise each rotatably mounted on the joint pins 80. The conveyor chain 70 is preferably provided with such support rollers 86, 88 each time after a defined number of consecutive joint plates 76, 78. In addition, the conveyor chain 70 is deflected in the region of the transfer stations 28, 40 and thereby runs over deflector rollers 87, 89 (FIG. 2), of which one is driven by a motor.

The conveyor chain 70 is, furthermore, provided with a skid frame pickup designated as a whole as 90 which comprises a front supporting element 92 and a rear supporting element 94, both of which are held on the conveyor chain 70 at a defined distance. The supporting elements are, as illustrated in FIGS. 4 to 6, thereby arranged in place of a pair of outer joint plates 76 and comprise two carriages 96 and 98 each with two side walls 97 and 99 which replace the joint plates 76 with joint plate regions 100 and 102, respectively, and mount consecutive joint pins 80 at the same intervals, whereby each joint pin 80 of a carriage 96 and 98 protrudes laterally beyond the side walls 97 and 99 and bears two respective support rollers 86 and 88.

The side walls 97 and 99 extend with a support section 104 and 106, respectively, at right angles to the direction of conveyance 50, in the upper part 72 upwards above the conveyor chain 70 and in the lower part 74 downwards. A bearing block 108 is connected with this support section 104 or 106. This bearing block, for its part, holds a cross support 110 which extends in a horizontal transverse direction 112 approximately at right angles to the direction of conveyance 50 and bears at its ends support rollers 114 and 116 which are rotatable about an axis 118 parallel to the transverse direction 112 and have a cylinder surface coaxial to the axis 118 as support surface 120 or 122 as well as a guide surface 124 and 126, respectively, extending in radial direction beyond the support surfaces 120 and 122, respectively, with a large taper angle on an inner side of these support surfaces 120, 122. The support rollers 114 and 116 are hereby arranged on the cross support 110 such that each support surface 120 or 122 extends from an inner edge 128 and 130 of the respective skid runner 52, 54 in the direction of an outer edge 132 and 134, respectively, thereof over a maximum of half the width of the respective skid runner 52 or 54 whereas the guide surfaces 124 and 126 abut approximately on the respective inner edge 128 or 130 of the respective skid runner 52 or 54.

In this way, the support rollers 114 and 166 merely support the skid frame 24 without, however, fixing it position.

Figure 7:
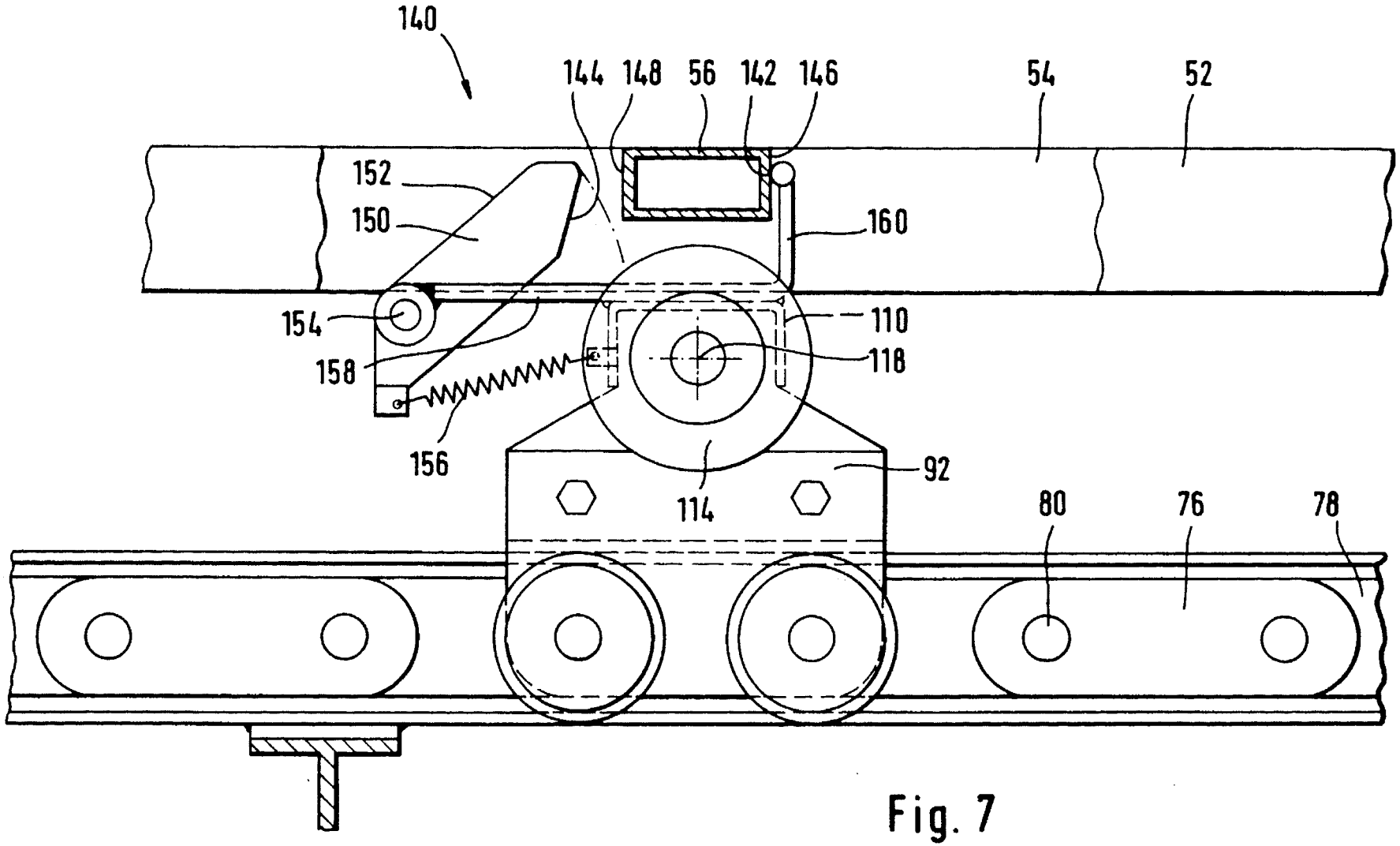
FIG. 7 is an enlarged illustration of a detail of an entrainment means in a view similar to FIG. 4.

In the first embodiment, the front supporting element 92, as illustrated in FIGS. 6 and 7, comprises, in addition, entrainment means 140 which engage on the front crossbar 56 of the skid frame 24 and have a rear entrainment surface 142 as well as a front entrainment surface 144 which engage over a rear side 146 and a front side 148 of the crossbar 56 and therefore secure the crossbar 56 in place against any relative movement, both in the direction of conveyance 50 and also contrary thereto, relative to the front supporting element 92 during the entrainment of the respective skid frame 24.

In order to position the front crossbar 56 between the two entrainment surfaces 142 and 144 in the transfer station 28, the front entrainment surface 144 is mounted on a pawl 150 which comprises an inclined abutting surface 152 and is pivotable about an axis 154 parallel to the axis 118 in the direction towards the cross support 110. Thus, when the skid frame 24 is located in the transfer station 28 and the front supporting element 92 approaches the respective skid frame 24 from below and in the direction of conveyance, the inclined abutting surface 152 comes to rest on the crossbar 56, namely on the rear side 146 thereof, and due to the relative movement of the front supporting element 92 in relation to the skid frame 24 the pawl 150 pivots downwards due to the action of the inclined abutting surface 152 so that the front entrainment surface 144 also moves in the direction of the cross support 110 and the entire pawl 150 can be moved through beneath the crossbar 56. In addition, the pawl 150 does not move upwards again until the front entrainment surface 144 is located in front of the front side 148 of the crossbar 56 in the direction of conveyance 50.

For this purpose, the pawl 150 is acted upon by a spring 156 in the direction of its position pivoted away from the cross support 110, in which the front entrainment surface 144 is positioned in front of the front side 148 of the crossbar 56.

The pawl 150 is preferably mounted on a base plate 158 of the entrainment means 140 which is, for its part, seated on the cross support 110 and has an arm 160 which is bent upwards and bears the rear entrainment surface 142.

As illustrated in FIG. 6, two entrainment means 140 are preferably provided on the front supporting element 92, each time close to the support rollers 114 and 116.

In the transfer station, the skid frame pickup approaches the skid frame 24 located therein from below with a relative speed greater than zero, travels through with the pawl 150 and the crossbar 56 so that the entrainment means 140 moves the skid frame 24 along with the entrainment surface 142.

At the same time, the support rollers 114, 116 of the supporting element 92 support the skid frame. When the skid frame 24 is moved further in the direction of conveyance 50, this is drawn further and further away from the tracks 60 and 62 until it is likewise seated on the support rollers 114, 116 of the supporting element 94.

In order to obtain a transfer in the transfer station 28 which is as far as possible jerk-free, the last roller or rollers 64L thereof are preferably designed such that they support the skid runners 52, 54 merely in the region from their outer edges 132, 134 in the direction of their inner edges 128, 130 over a maximum of half their width so that it is possible for the skid frame pickup 90 to already take up the skid frame 24 in the region of this last roller 64 (FIGS. 5, 6).

With the skid frame 24 supported, it is possible to adjust the length when travelling through the curve 166, which follows the transfer station 28 and along which the conveyor chain 70 extends, simply by the supporting element 94 being freely movable with its support rollers 114, 116 along the skid runners 52, 54 in the direction of conveyance 50 and contrary thereto (FIG. 2*a*).

Figure 8:
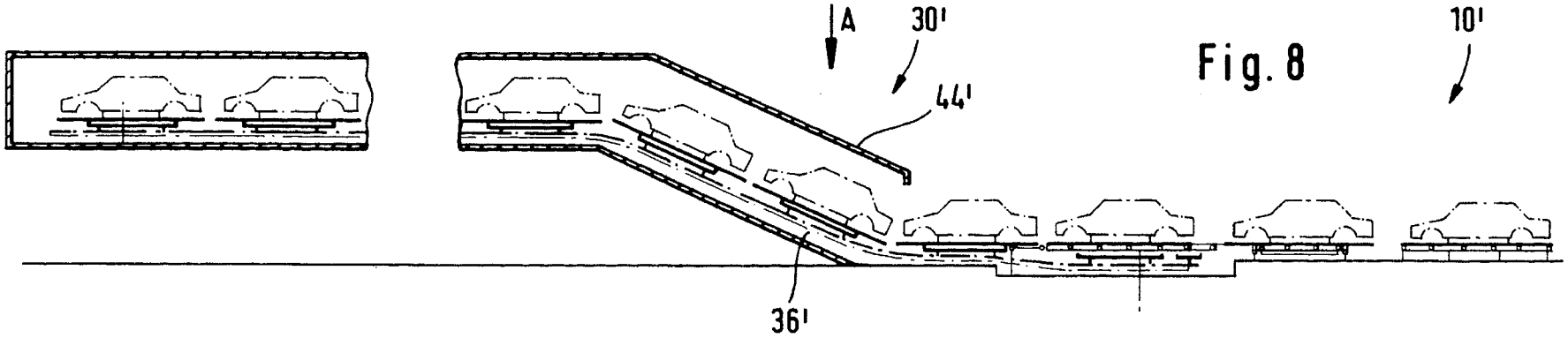
FIG. 8 is a detail longitudinal section through a second embodiment of an inventive coating plant.
Figure 9:
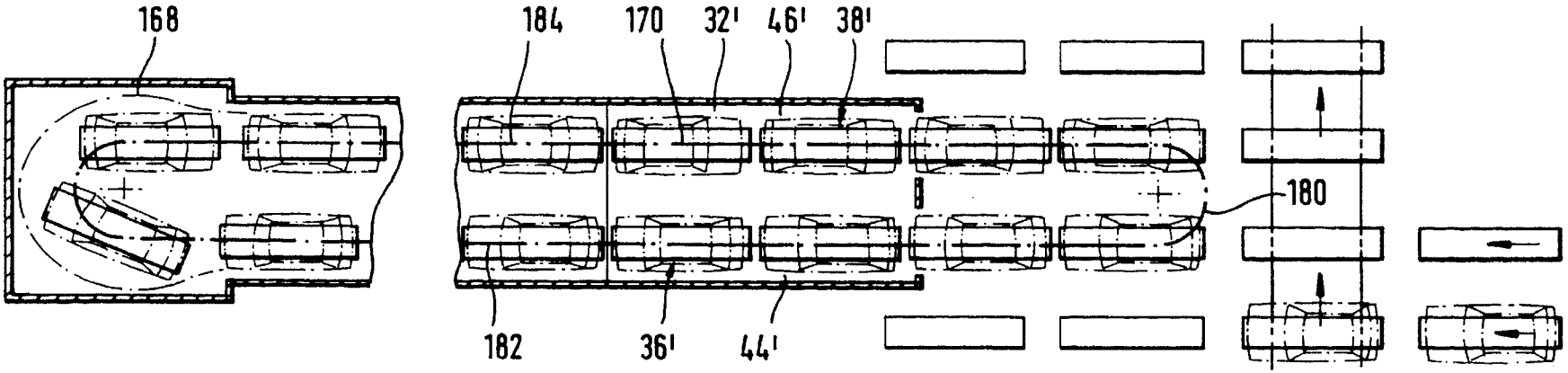
FIG. 9 is a plan view onto the second embodiment in the direction of arrow A in FIG. 8.

In a second embodiment of an inventive coating plant 10', sections of which are illustrated in FIGS. 8 and 9, the drier booth 32' is designed such that it has a loop 168 located in a horizontal plane so that the skid frames 24 with the workpieces 14 arranged thereon can travel back in the drier booth 32' in the opposite direction and the inlet air lock 44' with the inclined plane 36' is located next to the outlet air lock 46' with the inclined plane 38'.

In this embodiment, the conveyor chain 170 is designed such that its joint elements 176 and 178 are pivotable relative to one another about two axes 172 and 174 extending vertically on top of one another and also to the direction of conveyance. The conveyor chain 170 is designed as an endless chain and runs from a loop 180 which is at the skid conveyor level SFH to a loop 168 which is at drier level TH with a first part 182 and from the loop 168 to the loop 180 with a second part 184.

Figure 10:
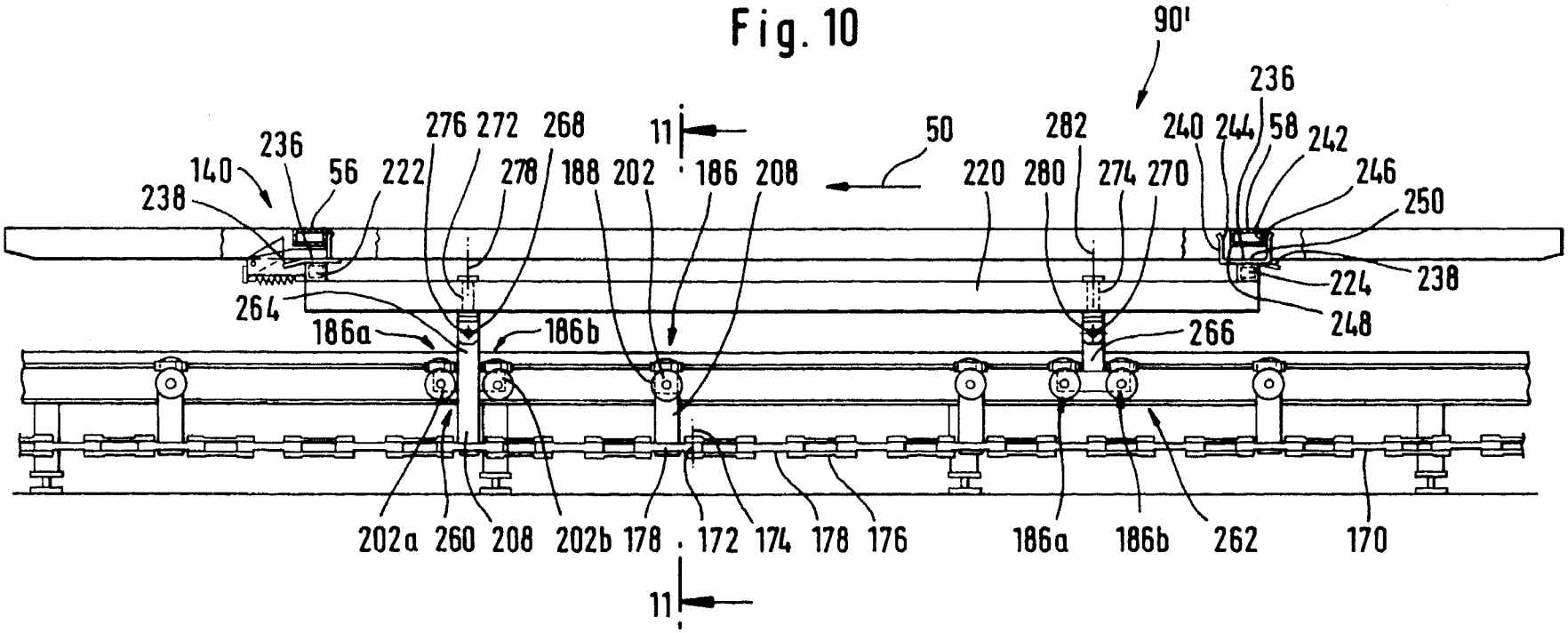
FIG. 10 is a side view of the skid frame pickup of the second embodiment in a view similar to FIG. 4.

The chain 170 is, as illustrated in FIG. 10, supported by sets 186 of support rollers arranged each time after a specified number of chain links 176 and 178, whereby each set 186 of support rollers comprises two support rollers 188 and 190, which are arranged in spaced relation to one another in horizontal direction and each run in C-shaped profiled supports 192 and 194, respectively, which face one another with their open sides, as well as a lateral guide roller 196 which runs between lateral guide bars 198 and 200 arranged on both sides of the lateral guide roller 196, whereby the lateral guide bars 198 and 200 are held on the profiled supports 192 and 194. The two support rollers 188 and 190 as well as the lateral guide roller 196 are each rotatably mounted on a roller block 202 which has a shaft 204 for the support rollers 188 and 190 extending essentially horizontal and a shaft 206 for the lateral guide roller 196 extending essentially vertical.

Proceeding from each roller block 202, a support arm 208 extends to the chain link arranged beneath the respective roller block, for example a chain link 178. This means that the chain 170 runs beneath the profiled supports 192 and 194.

In order to give the chain 170 an additional guidance, especially in the loops 168 and 180, a guide roller 210 is provided in addition in the region of the loops 168 and 180 and this forms a support for the chain links 176 and 178 on the inside of the curve.

The C-shaped profiled supports 192 and 194 are, for their part, preferably held on a frame 212 of the drier conveyor 30' which preferably forms a mounting for the guide roller 210, as well.

In the second embodiment 30' of the inventive drier conveyor, a skid frame pickup 90' comprises a longitudinal support 220 extending in the direction of conveyance 50 and connecting a front supporting element 222 and a rear supporting element 224 with one another. Each of the supporting elements 222 and 224 comprises, for its part, a cross support 226 which extends in the transverse direction 112 transversely to the direction of conveyance 50 and essentially horizontal and has at its two outer ends support surfaces 228 and 230, respectively, which extend from inner edges 128 and 130 of the skid runners 52 and 54, respectively, in the direction of outer edges 132 and 134 of the skid runners 52 and 54, respectively, but to a maximum of half the width thereof. In addition, guide surfaces 232 and 234 extend from an inner side of the support surfaces 228 and 230, respectively, and form with the support surfaces 228 and 230, respectively, an angle greater than 90°. The guide surfaces 232 and 234 are preferably arranged such that the inner edges 128 and 130 of the skid runners 52 and 54, respectively, abut thereon.

In contrast to the first embodiment, the support surfaces 228 and 230 are preferably formed in a central region 236 as plane surfaces, in relation to which outer regions 238 are inclined slightly downwards.

In the second embodiment, the support surfaces 228 and 230 as well as the guide surfaces 232 and 234 are borne by a angle guide 239 arranged at the end of the transverse support 226 on an upper side thereof.

Just as in the first embodiment, one of the supporting elements 222 and 224 preferably comprises two entrainment means 140 which are arranged in spaced relation to one another and designed to be essentially identical to the first embodiment so that the same reference numerals have been used and with respect to the description thereof reference is made in full to the comments on the first embodiment.

For additionally securing the skid frame 24, the rear supporting element 224 also comprises an entrainment means 240 which is U-shaped in design and has a rear entrainment surface 242 and a front entrainment surface 244 which are positionable in an entrainment position so as to engage over a rear side 246 and a front side 248 of the rear cross support 58 of the skid frame 24. The rear entrainment surface 242 and the front entrainment surface 244 are preferably borne by a rigid, U-shaped bracket 250 which is seated on the cross support 226 of the rear supporting element 224.

In the transfer station 28, the entrainment means 240 can be moved up to the crossbar 58 such that the entrainment surfaces 242 and 244 engage around the crossbar 58 from below on both sides, i.e. to the front and back in the direction of conveyance.

Figure 11:
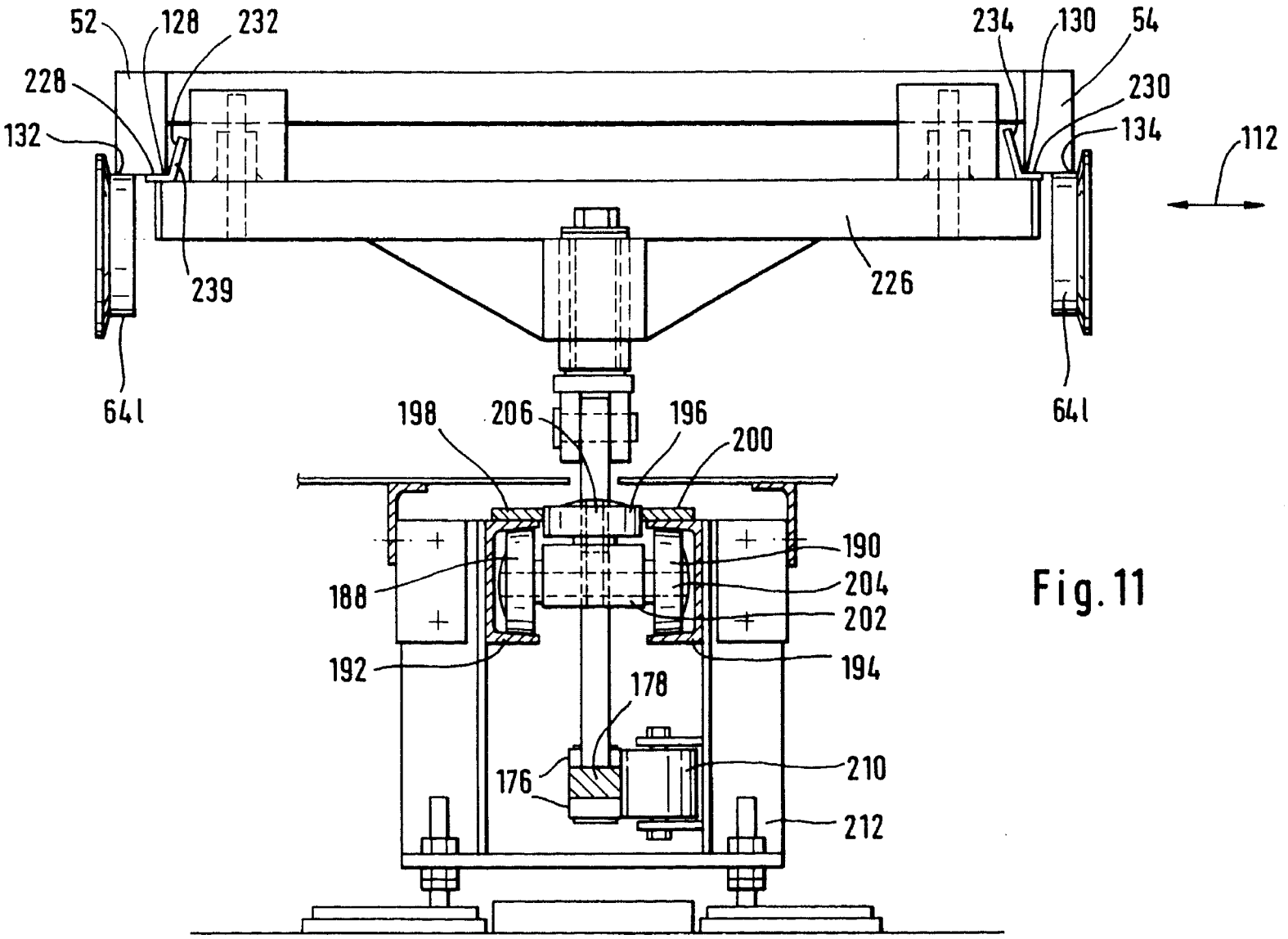
FIG. 11 is a section along line 11—11 in FIG. 10.

The longitudinal support 220 is, as illustrated in FIGS. 10 and 11, guided by two carriages 260 and 262, whereby the carriages 260 and 262 have two sets 186*a* and 186*b* of support rollers arranged in spaced relation to one another in the direction of conveyance. Their roller blocks 202*a* and 202*b* are rigidly connected with a support arm 264 and 266, respectively, which extends between the two sets 186*a* and 186*b* of support rollers in the direction of the longitudinal support 220. Each of the support arms 264 and 266 is connected via a first joint 268 and 270, respectively, and a second joint 272 and 274, respectively, to the longitudinal carrier 220, whereby both joints are rotatable about axes 276 and 278 or 280 and 282 which extend at right angles to the direction of conveyance 50 and are located vertically one above the other. The axes 276 and 280 are preferably located in horizontal planes and the axes 278 and 282 in vertical planes.

However, in the second embodiment only one of the carriages 260 and 262, for example the front carriage 260, is connected with the conveyor chain 170 via a support arm 208 extending in continuation of the support arm 264 and in the direction of the conveyor chain 170 while the carriage 262 is located between two consecutive sets 186 of support rollers of the conveyor chain, preferably in the center between two sets 186 of support rollers. This means that it is possible, in a simple manner, to guide the conveyor chain 170 both in a vertical plane and in a horizontal plane so as to be curved since the adjustment of length, due to the fact that the longitudinal support 220 is aligned parallel to a chord of an arc of the respective curve, is possible due to the carriage 262 being freely displaceable between consecutive sets 186 of support rollers of the conveyor chain 170 and, moreover, the pivot movement relative to the support arms 264 and 266 which is necessary for the alignment of the longitudinal support 220 parallel to the chord of the arc can take place as a result of the two joints 268 and 272 or 270 and 274, as illustrated in FIG. 12 with the example of the loop 180.

Figure 12:
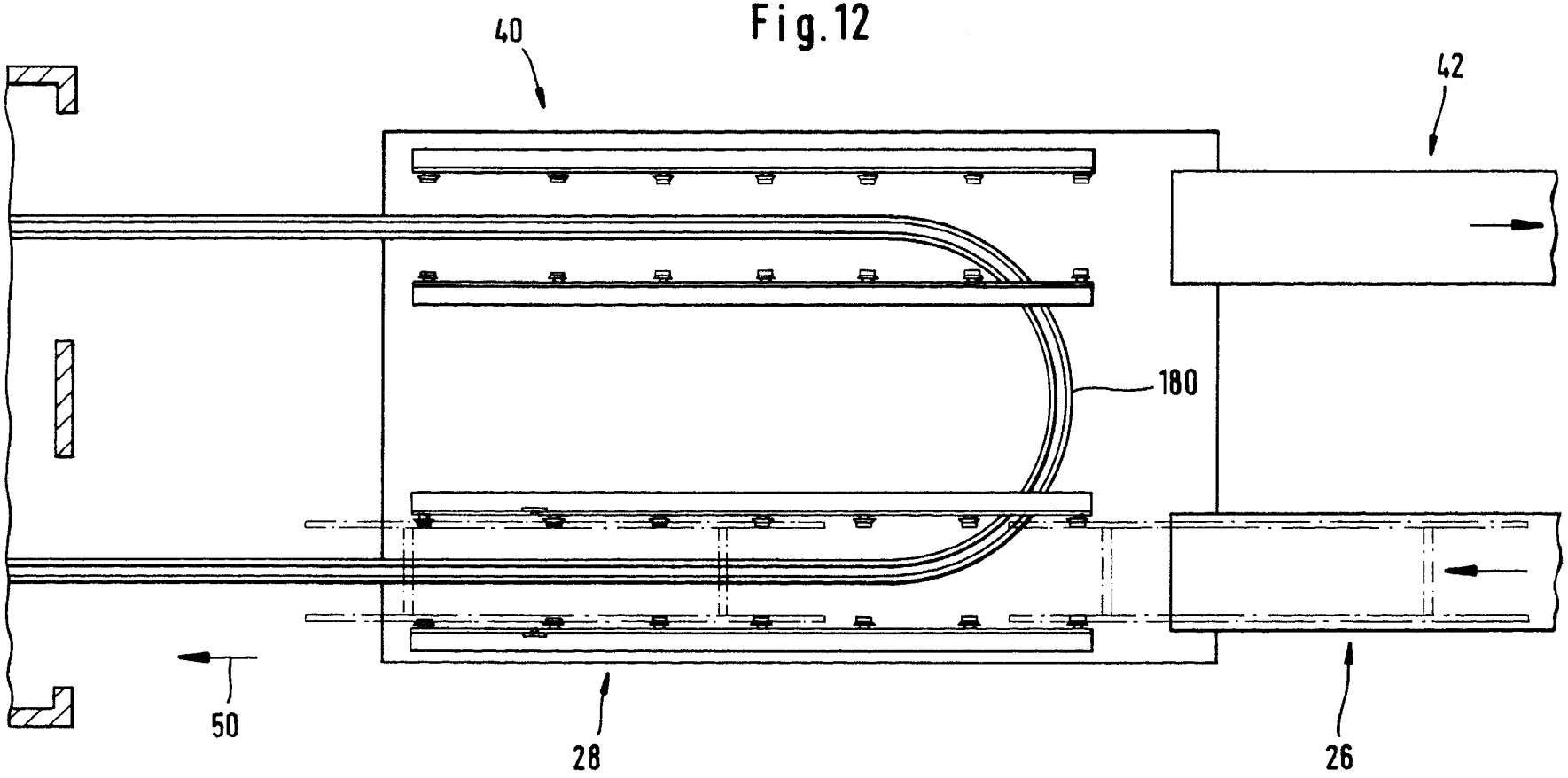
FIG. 12 is an enlarged illustration of a detail of a drier conveyor in the region of the transfer station and FIG. 13 is a side view similar to FIG. 10 in the region of the transfer station.
Figure 13:
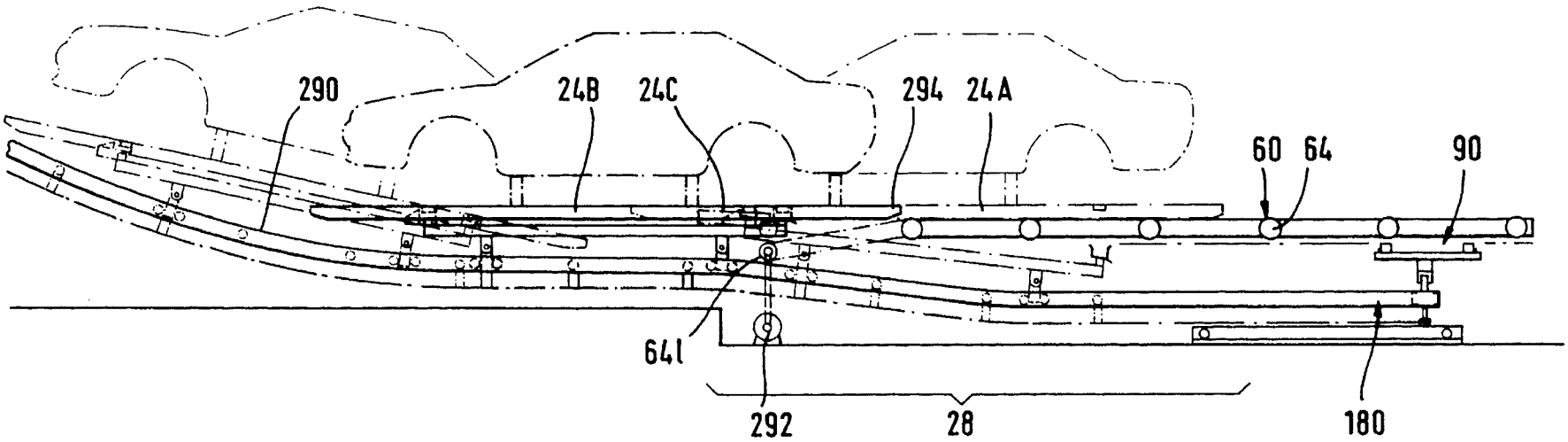

As also illustrated in FIGS. 12 and 13, the transfer stations 28 and 40 are located in the direction of conveyance 50 either after or before the loop 180, whereby the skid conveyor 26, exactly as in the first embodiment, supplies the skid frames 24 with the workpieces 14 to the transfer station 28 and the skid conveyor 42 takes the skid frames 24 with the workpieces 14 away from the transfer station 40.

In the case of the transfer station 28, illustrated in FIG. 13, the loop 180 is located at a lower level in relation to the sets 60 and 62 of rollers 64 so that the skid frame pickups 90' describe the loop 180 beneath the sets 60 and 62 of rollers 64. Following this, the profiled supports 192 and 194 guiding the carriages 260 and 262, respectively, are guided upwards from below such that when a skid frame 24A is located in the transfer station 28 the entrainment means 140 of the front supporting element 220 first of all entrain the front crossbar 56 of the skid frame and, at the same time, support this in the region of its skid runners 52 and 54 via the support surfaces 228 and 230, then move it further along in the direction of conveyance 50 until, as in the case of the skid frame 24B, the entrainment means 240 also engages around the crossbar 58 of the skid frame from below and, at the same time, the supporting element 224 supports this in the region of the skid runners 52 and 54. The skid frame is now completely taken up by the skid frame pickup 90' and is carried free from the drier conveyor 30'. If, as illustrated in FIG. 13, an upwardly directed curve 290 immediately follows the transfer station 28, a last roller 64L of the respective set 60 and 62 of the skid conveyor 26 is, preferably, pivotable downwards by means of a drive 292 in order not to hinder a rear end 294 of the skid frame in position 24C.

The width of the roller 64L hereby corresponds merely to half the width of the skid runners 52 and 54 so that, as illustrated in FIG. 11, the respective, last roller 64L of the set 60 and 62 bears the respective skid runner 52 or 54 proceeding from its respective outer edge 132 or 134 in the direction of its respective inner edge 128 or 130 over a maximum of half the respective width.

We claim:

1. Coating plant for workpieces, comprising:

a coat application section including a skid conveyor extending therethrough at a first level, a coat drier section following said application section and comprising a drier booth and a drier conveyor, said drier conveyor extending through said drier booth and said coat drier section;

said drier booth being arranged at a second level, which is higher than said first level;

said skid conveyor passing through the coat application section and moving workpieces set on skid frames through the coat application section at a process feeding speed for the application of the coating, and said drier conveyor following the skid conveyor and conveying the skid frames with the coated workpieces set thereon through the coat drier section, said drier conveyor moving the skid frames at the process feeding speed along a skid frame path through said drier booth and the coat drier section, said drier conveyor extending beneath the skid frame path in a take over section for taking over said skid frames at said first level and thereafter lifting said skid frames to said drier booth at said second level via a conveyor section extending parallel to an inclined plane from said first level to said second level to subsequently convey said skid frames through said drier booth.

2. Coating plant as defined in claim 1, further comprising an additional work section following the coat drier section and having a skid conveyor on an outlet side of said coat drier section.

3. Coating plant as defined in claim 1, wherein the drier conveyor conveys the skid frames in an end region of the coat drier section via an inclined plane downwards to a skid conveyor on the outlet side.

4. Coating plant as defined in claim 1, wherein the skid frames are guided in the region of the drier conveyor with skid runners free from runner tracks.

5. Coating plant as defined in claim 1, wherein the skid conveyor brings the skid frames to a transfer station and the drier conveyor takes up the skid frames in the transfer station.

6. Coating plant as defined in claim 5, wherein the drier conveyor approaches the respective skid frame from below in the transfer station with a skid frame pickup and takes up said skid frame.

7. Coating plant as defined in claim 6, wherein the skid frame pickup supports the skid frames at two places spaced from one another in the direction of conveyance with a respective supporting element.

8. Coating plant as defined in claim 6, wherein the skid frame pickup supports the skid frame at skid runners.

9. Coating plant as defined in claim 7, wherein the drier conveyor supports the skid frame with its two supporting elements

10. Coating plant as defined in claim 9, wherein the supporting elements have support surfaces for the respective skid frame.

11. Coating plant as defined in claim 9, wherein the supporting elements have guide surfaces for the respective skid frame.

12. Coating plant as defined in claim 1, wherein a skid frame pickup is guided on guide rails, said skid frame pickup including two carriages arranged in spaced relation to one another.

13. Coating plant as defined in claim 12, wherein the carriages are guided in the guide rails by two pairs of support rollers arranged in spaced relation to one another.

14. Coating plant as defined in claim 12, further comprising two supporting elements, each of which is seated on its own respective carriage.

15. Coating plant as defined in claim 14, wherein the carriages are connected to one another via a conveying element.

16. Coating plant as defined in claim 15, wherein the conveying element guides the supporting elements so as to be aligned parallel to one another transversely to a direction of conveyance.

17. Coating plant as defined in claim 14, wherein at least one of the supporting elements supports the respective skid frame variably in a direction of conveyance.

18. Coating plant as defined in claim 1, further comprising two carriages supporting each skid frame, wherein one of said carriages is rigidly connected to a conveying element and the other carriage is freely displaceable relative to said conveying element.

19. Coating plant as defined in claim 18, wherein the two carriages are connected to one another via a longitudinal support.

20. Coating plant as defined in claim 19, wherein two supporting elements are arranged on the longitudinal support.

21. Coating plant as defined in claim 19, wherein the longitudinal support is connected with each of the carriages via at least one joint.

22. Coating plant as defined in claim 21, wherein joint axes of the joints are aligned parallel to one another.

23. Coating plant as defined in claim 21, wherein the carriages are connected to the longitudinal support via two joints.

24. Coating plant as defined in claim 18, wherein the conveying element is a conveyor chain.

25. Coating plant as defined in claim 24, wherein the conveyor chain has chain links movable relative to one another at least about one axis.

26. Coating plant as defined in claim 25, wherein the chain links are pivotable relative to one another about two axes.

27. Coating plant as defined in claim 1, wherein the drier conveyor engages on the respective skid frame with an entrainment means detachably connectable to the skid frame.

28. Coating plant as defined in claim 27, wherein the entrainment means engages on an entrained element arranged on the skid frame.

29. Coating plant as defined in claim 27, wherein the entrainment means secures the skid frame against any relative movement in a direction of conveyance or contrary to the direction of conveyance.

30. Coating plant as defined in claim 27, wherein the entrainment means has an entrainment surface arranged behind an entrained element in the direction of conveyance and an entrainment surface arranged in front of the entrained element in the direction of conveyance.

31. Coating plant as defined in claim 27, wherein the entrainment means is securable on an entrained element by locking.

32. Coating plant as defined in claim 31, wherein an entrainment surface is seated on a pawl.

33. Coating plant as defined in claim 27, wherein the entrainment means is arranged on a supporting element.

34. Coating plant as defined in claim 12, wherein a conveying element extends between the guide rails for the carriages.

35. Coating plant as defined in claim 12, wherein a conveying element is arranged to be vertically offset from said guide rails.

36. Coating plant according to claim 1 wherein said drier booth comprises an inlet air lock extending from said drier booth downwards along said inclined plane.

37. Coating plant according to claim 36 wherein said inlet air lock extends as far as said skid conveyor level.

38. Coating plant according to claim 1 wherein each skid comprises two skid runners arranged in spaced relation to one another transverse to the direction of conveyance.

39. Coating plant according to claim 38 wherein the two skid runners are connected to each other by a crossbar.

* * * * *